US006793773B2

(12) United States Patent
Juppi et al.

(10) Patent No.: US 6,793,773 B2
(45) Date of Patent: Sep. 21, 2004

(54) METHOD AND SYSTEM IN A PAPER MACHINE OR THE LIKE PASSING A WEB FROM THE PRESS SECTION TO THE DRYING SECTION

(75) Inventors: Kari Juppi, Palokka (FI); Antti Komulainen, Keuruu (FI)

(73) Assignee: Metso Paper, Inc., Helsinki (FI)

( * ) Notice: Subject to any disclaimer, the term of this patent is extended or adjusted under 35 U.S.C. 154(b) by 39 days.

(21) Appl. No.: 10/297,379

(22) PCT Filed: Jun. 7, 2001

(86) PCT No.: PCT/FI01/00538

§ 371 (c)(1),
(2), (4) Date: Dec. 5, 2002

(87) PCT Pub. No.: WO01/94694

PCT Pub. Date: Dec. 13, 2001

(65) Prior Publication Data

US 2003/0183354 A1 Oct. 2, 2003

(30) Foreign Application Priority Data

Jun. 9, 2000 (FI) ..... 20001372

(51) Int. Cl.[7] ..... D21F 1/36

(52) U.S. Cl. ..... 162/193; 162/255; 162/289; 226/91; 34/117; 34/114

(58) Field of Search ..... 162/193, 255, 162/289; 226/91; 34/117, 114

(56) References Cited

U.S. PATENT DOCUMENTS 5,232,555 A 8/1993 Daunais et al.
5,240,563 A * 8/1993 Karvinen et al. ..... 162/274
5,509,215 A * 4/1996 Koiranen et al. ..... 34/117
6,317,999 B1 * 11/2001 Virta et al. ..... 34/114

FOREIGN PATENT DOCUMENTS

| | | |
|---|---|---|
| EP | 0 364 114 | 4/1990 |
| FI | 990370 | 8/2000 |
| WO | WO 00/50692 | 8/2000 |
| WO | WO 00/50693 | 8/2000 |
| WO | WO 01/94694 | 12/2001 |

OTHER PUBLICATIONS

International Search Report issued in International Patent Application No. PCT/FI01/00538.

International Preliminary Examination Report Issued in International Patent Application No. PCT/FI01/00538.

* cited by examiner

*Primary Examiner*—Peter Chin
*Assistant Examiner*—Mark Halpern
(74) *Attorney, Agent, or Firm*—Stiennon & Stiennon

(57) ABSTRACT

A paper web (w) is passed from the press section (10) to the drying section in a paper machine. The drying section has at least one transfer suction roll (16) for passing the web in a closed draw from the transport belt (12) of the press section to the drying wire (F) of the first cylinder drying group (14). The cylinder drying group has at least one vacuum box (30) stabilising the travel of the web. A high negative pressure is maintained in the transfer suction roll, this pressure being between −35 kPa and −80 kPa in order to attach the web to the drying wire.

11 Claims, 4 Drawing Sheets

METHOD AND SYSTEM IN A PAPER MACHINE OR THE LIKE PASSING A WEB FROM THE PRESS SECTION TO THE DRYING SECTION

CROSS REFERENCES TO RELATED APPLICATIONS

This application is a U.S. National stage application of PCT/F101/00538, filed Jun. 7, 2001, and claims priority on Finnish application Ser. No. 20001372, filed on Jun. 9, 2000.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method and a system in a paper machine or the like for passing a web from the press section to the drying section. Thus the invention relates particularly to such paper machine solutions, where the web is passed from the press section to the drying section in a closed draw, i.e. directly from the press fabric, felt or other belt, such as a transport belt, to the drying wire of the first drying group of the drying section. The web is passed with the aid of a transport suction roll.

In a drying section provided with a single wire draw, the web is directed in the first drying group, supported by the wire, over the first drying cylinder and from there further in a way known as such, supported by a suction roll or the like, to the second drying cylinder of the drying group, and so on, alternately over a hitch roll, typically a suction roll, and alternately over a drying cylinder. The passage of the web from a drying cylinder to a hitch roll is stabilised in a manner known as such, with the aid of a vacuum box arranged in a pocket formed between the drying cylinders and the hitch roll, preferably at the opening gap between the wire and the first drying cylinder in the travelling direction of the web. Corresponding vacuum boxes are typically arranged also in the pockets formed between the next drying cylinders and the hitch rolls.

FIG. 1 shows a typical travel of the web w in the opening gap between the drying cylinder A and the drying wire F. As shown in FIG. 1, the web tends to follow the surface of the drying cylinder and momentarily to become detached from the drying wire. As the web is detached it creates a pouch, which is difficult to return into contact with the wire in a neat manner. Further problems are caused by the fact that the wire does not detach from the surface of the drying cylinder in a completely symmetrical manner in the cross direction of the web, whereby the travel of the web is not completely uniform even in the cross direction of the web, and pouches, folds and other damages, even breaks, are caused in the web. Pouches in the machine direction are visible all the way to the next cylinder.

The above mentioned problems occur particularly at high running speeds, and when the effect of the vacuum box is not sufficient to control the travel of the web in the opening gap. Within certain limits it is possible to treat the problems with the aid of vacuum boxes, i.e. it is possible to aid the web to detach from the drying cylinder and to be reattached to the drying wire.

However, it may be problematic to adjust the negative pressure in the vacuum box, so that full control over the travel of the web is obtained. If the negative pressure of the vacuum box is too low, e.g. −100 Pa, there will be difficulties in detaching the wire from the cylinder, which results in the above mentioned problems. However, a low negative pressure is advantageous in that the negative pressure returns a detached web to the wire at a small angle, i.e. in a relatively well controlled manner. If, on the contrary, the negative pressure is relatively high, e.g. −500 Pa . . . −1000 Pa, depending on the box type, then the web will detach more easily from the cylinder and it will not form a pouch which is as large as when running at a low negative pressure. However, then there may rise a problem in that the web is returned too violently to the wire. A high negative pressure will violently suck the web with a sharp twitch against the wire, which may cause damages in the web or further weaken already weak spots in the web, which easily results in a web break in the respective pocket or later on.

A too high negative pressure also causes difficulties by bending the wire towards the vacuum box. Thus a high negative pressure will hinder the wire from passing straight towards the hitch roll, but it will form an arch on the section between the drying cylinder and the hitch roll. Then the wire may come into contact with structures of the vacuum box, if the box is not shaped to be arched in a corresponding manner. Even the shaping of the box will not always help, as the wire is arched in a different way in different phases of a run.

The detachment of the web can be secured and bending of the wire can be avoided by using a vacuum box divided into different negative pressure levels, such as the HiRun box presented in WO 00/50693 of Metso Paper, Inc., where the negative pressure in the travel direction of the web in the first part of the box, i.e. at the opening gap, is higher than in the next part or parts of the box.

However, it would be advantageous if the detachment of the web from the drying wire could be totally or almost totally avoided, and if the web could be made to pass from the drying cylinder to the hitch roll in a controlled manner, so that it follows the wire.

A poor detachment of the web from the cylinder, and the creation of pouches, folds or other damages makes it more difficult to run the web in the next stages. A web break due to a poor detachment can occur both immediately after the gap and even after several drying cylinders. The number of breaks in the drying section depends also on other interfering factors impeding the travel of the web at the beginning of the drying section. There will be less breaks if the web passes faultlessly in the gaps opening from the cylinders. The number of breaks can on their part be regarded to represent the runability.

Many factors have an effect on the above mentioned travel of the web in the opening gap of a drying cylinder, and thus on the runability in the drying section, such factors being e.g.

- the quality of the pulp, e.g. the length of the fibres,
- the dry solid contents of the web,
- the tension difference between the press section and the drying section,
- the mechanical shaping of the web in the press section and in the passing of the web before the drying cylinder,
- the relaxation velocity of the web
- the strength of the web, and
- the temperature of the cylinders. Attempts have been made to act on some of these factors in order to improve the runability.

In order to remove the problems caused by the detachment of the web there has been traditionally attempts e.g. to increase the tension difference between the press section and the drying section. This causes an internal tension in the web, which aids in detaching the web from the cylinder and thus it improves the runability. However, there is a limit to the increase of the tension difference. An increased tension difference increases the number of breaks. Further, a too much increased tension difference has an disadvantageous effect for instance on the quality characteristics of the web. As the speeds of the paper machine increase there has also emerged a growing need to increase the tension differences in order to retain the runability.

There have also been attempts to keep the temperature of the surface of the drying cylinder at the beginning of the drying section on a level at which the web does not bum to the surface of the cylinder. This solution is less good regarding the drying efficiency of the drying section.

The above mentioned runability problems at the beginning of the drying section have among other things often resulted in that it has been necessary to shorten the length of the cylinder group at the beginning of the drying section, which increases costs.

SUMMARY OF THE INVENTION

The object of the invention is to achieve a method and a system for passing a paper web or the like from the press section to the cylinder drying group, where the above mentioned problems are minimised.

Thus an object of the invention is to provide a reliable method and system for passing a paper web or the like from a press section to a cylinder drying group.

Then the object of the solution according to the invention is among other things to pass the web from the press section to the drying section with a minimum tension difference, in some cases even completely without tension, or even with a negative tension difference, however, maintaining the optimal running conditions in the drying section and a good paper quality.

A further object is to provide a method and a system for passing the web from the press section to the drying section so that a good runability is maintained in the drying section also with drying groups of traditional lengths, i.e. with unshortened drying groups.

Thus the solution according to the invention proposes to use a substantially higher negative pressure level than conventionally in the transfer suction roll of the drying section. The transfer suction roll should typically maintain a negative pressure which is between −35 kPa and −80 kPa, typically between −40 kPa and −65 kPa, most typically >−50 kPa.

Previously it was not considered necessary to maintain a high negative pressure level in this transfer suction roll. The object has been only to detach the web from the fabric of the press section or belt and to pass it to the wire of the drying section. The negative pressure of the transfer suction roll was not considered to have any effect after this passing, and thus no effect on the run of the web, on the runability, or on the drying process in the drying groups. Often it is secured that the web is kept on the drying wire immediately after the passing, for instance with the aid of vacuum boxes.

However, now it was found that the transfer suction roll can be used, not only to pass the web away from the felt of the press section, but also to attach the web to the wire of the drying section in a more robust manner than previously, so that this attachment has an effect also after the opening gap of the first drying cylinder. It was found that when the web is attached better than previously to the wire at the transfer suction roll, this will have an effect even at the opening gap after the drying cylinder, where a web which is once attached to the wire in a proper manner will detach from the drying cylinder in a more easier manner than previously. Previously the detachment of the web from the cylinder was aided by increasing the tension difference, i.e. by increasing the tension in the web. The tension difference in the web is increased as it passes from one fabric to another, i.e. at the suction roll.

Previously an aim was to keep the web attached to the wire of the drying section with the negative pressure level of the vacuum box in the pocket between the first and second drying cylinders, or to attach the web again to this wire if it detached. However, a disadvantageous negative pressure level could cause an unstable travel of the web in the opening gap, whereby any detachment of the web may cause pouches or folds in the web, which impairs the runability and the paper quality.

As described above, an aim has been to compensate for the problems caused by pouches and folds in the web by increasing the tension difference between the press section and the drying section. Then it was often necessary to increase the tension difference even up to the tolerance limits of the web.

In the solution according to the invention it is therefore an aim to minimise the detachment of the web from the drying wire by attaching it particularly well to the wire before the drying cylinder. During the whole pass in the opening gap the web is kept in this way on the surface of the wire, or is detached from it only in an unsubstantial way, i.e. so little that the passage of the web is fully controlled, both in the opening gap and after the gap.

In the solution according to the invention the aim is to secure that the attachment between the web and the drying wire which occurs at the transfer suction roll will last as long as possible. As a result it is not necessary to make the negative pressure of the vacuum box after the cylinder as high as in the known solutions in order to control the runability.

In the solution according to the invention the negative pressure prevailing in the transfer suction roll and the tension difference between e.g. the press section and drying section can be adjusted to such a level that both an optimal running situation and optimal paper quality criteria are obtained. The adjustment takes into account the general running situation, the equipment of the paper machine, the pulp quality and characteristics, as well as the quality of the paper being manufactured.

According to the invention the high negative pressure of the transfer suction roll has a particularly favourable effect on the runability at high running speeds, for instance over 1200–1500 m/min, depending on the paper quality. At low running speeds, e.g. below 1000–1200 m/min, the negative pressure level has not so substantial an effect, but a slightly lower negative pressure than normal will be sufficient.

The higher negative pressure in the transfer suction roll, the better the web will tend to follow the wire. As the negative pressure increases the contact surface between the web and the wire will increase. The dry solid contents of the web also has an influence. The wetter the web, the more easily the web will be shaped according to the surface of the wire and increase the attachment area. A risk with a too high negative pressure can be that the web is sucked into the wire, whereby the wire may cause a marking in the web, which is not desired.

Previously it was necessary to choose the tension difference between the press section and the drying section in accordance with the runability. According to the invention, the runability can now be controlled also through the negative pressure of the transfer suction roll, and thus the tension difference will not have an equally great importance, if any, regarding the runability. When using the solution according to the invention the tension differences can be reduced to a substantially lower level, compared to those used previously.

The selection of the tension difference is normally influenced by the paper quality and the machine speed. As the negative pressure is kept relatively high according to the invention, then the tension difference can be typically adjusted as follows:

- in the region <1%, when the machine speed is 600 to 1200 m/min;
- in the region <1.5%, when the machine speed is 1200 to 1500 m/min;
- in the region <2%, when the machine speed is 1500 to 1800 m/min;
- in the region <2.5%, when the machine speed is >1800 m/min.

The machine can be run even with a tension difference of zero by utilising the solution according to the invention. In test runs it has been found that even at a speed of 1600 m/min it is possible to run with a tension difference of zero. In a conventional production machine, i.e. with a lower negative pressure in the transfer suction roll, the tension difference should be of the order of 3 to 4% at a speed of 1600 m/min.

The solution according to the invention, where the selection of the tension difference does not have so great effect on the runability, the tension difference can be chosen according to other criteria than the runability. The tension difference can be chosen for instance according to requirements put by the paper quality to be manufactured or by the paper characteristics, such as porosity, stretch at break, strength, tensile energy absorption, dimensional stability, or by other properties.

The refining degree can also have an effect on the porosity, whereby it is possible with e.g. a low tension difference (0.5%) and a low refining degree (100 kWh) to save energy and maintain the same porosity as with a high tension difference (2%) and a high refining degree (150 kWh/tn).

In some cases the solution according to the invention also makes it possible to increase the steam pressure of the drying cylinders at the beginning of the drying section, which gives more capacity to the drying section. When the web is well attached to the wire it reduces the risk of a so called web burning to the drying cylinder. Previously it was possible to use only relatively low temperatures in the drying cylinders at the beginning of the drying section in order to avoid burning.

BRIEF DESCRIPTION OF THE DRAWINGS

Below the invention is described in more detail with reference to the enclosed drawings, in which.

DESCRIPTION OF THE PREFERRED EMBODIMENTS

Figure 1:
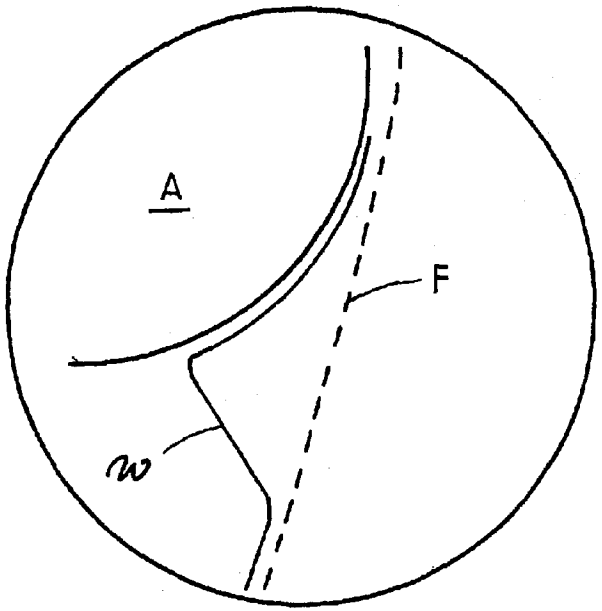
FIG. 1 PRIOR ART
FIG. 1 shows schematically a conventional section in the machine direction at the opening gap of the first drying cylinder of a paper machine.

FIG. 1 shows the conventional travel of the web w in the opening gap between the first drying cylinder A of the drying section and the drying wire F, where the drying wire detaches from the surface of the cylinder and passes towards the hitch roll, which is not shown. The web w, which until the opening gap has travelled supported by the wire F, is detached from the wire in the opening gap and follows the surface of the cylinder along a distance. The web returns to the wire, if the detachment from it is not so severe that a web brake occurs. The web which is detached from the wire forms a pouch with a size which may vary during the run, both in the travel direction of the web and in the machine cross direction. Then the web will also return to the wire at a steep or less steep, advantageously at a gently sloping angle. The return of the web may also occur by jerks, which may damage the web. The travel of the web in the opening gap is thus instable, which impairs the runability. In FIG. 1 the radius of the cylinder A is drawn considerably shorter than it is in reality, in order to show more clearly what is meant by pouching. The object of this invention is to provide a method with which, among other things, this shown inconvenient pouching of the web and its detrimental effect on the runability can be avoided.

Figure 2:
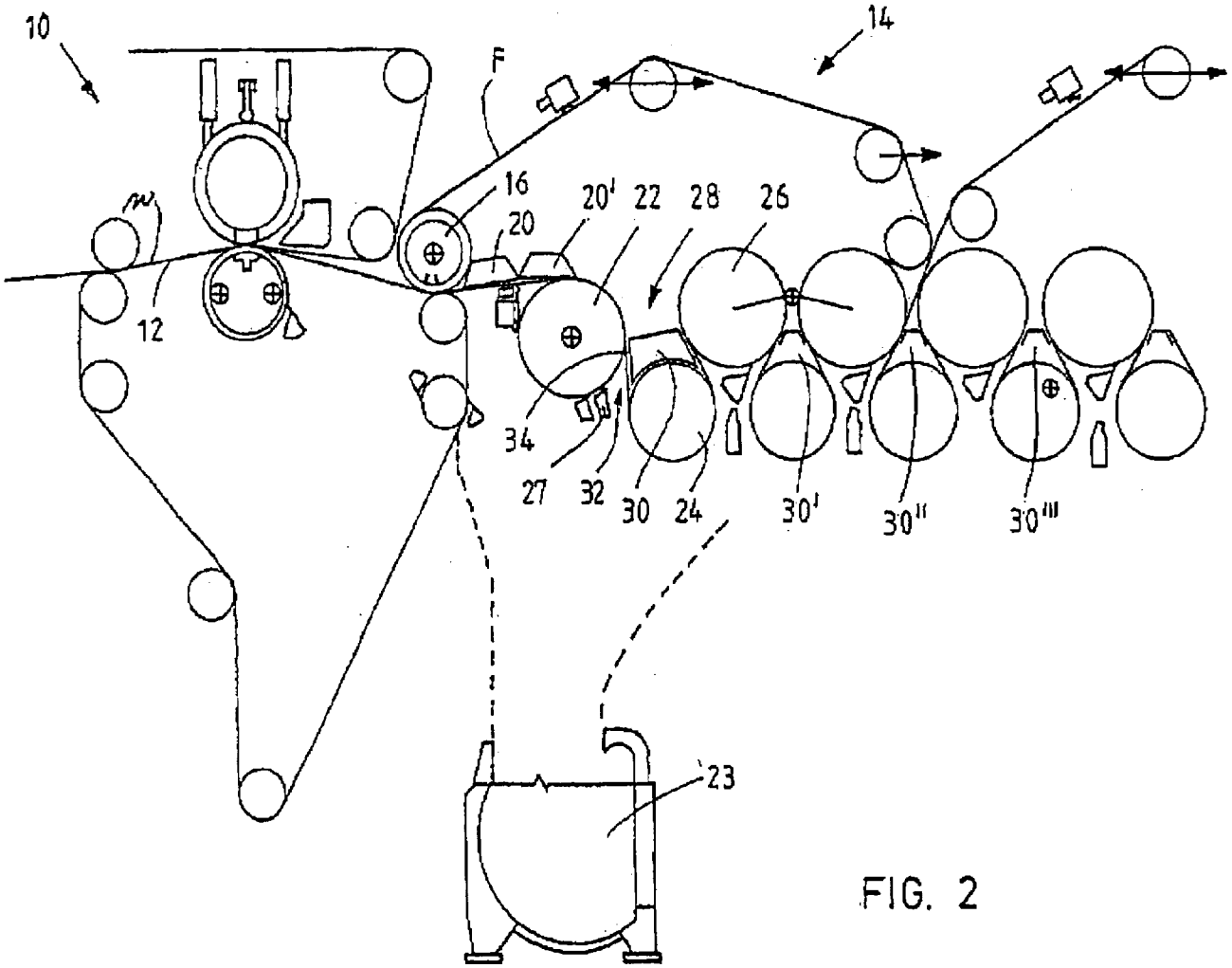
FIG. 2 shows schematically a section in the machine direction at the joint between the press section and the drying section, where the invention is applied.

FIG. 2 shows the end part 10 of the press section in a paper machine, whereby the transport belt 12 brings the web w from the end part to the drying wire F of the first drying group 14 in the drying section. Within the drying wire there is arranged a transfer suction roll 16, which with a negative pressure detaches the web w from the transport belt 12, and which according to the invention attaches the web with a high negative pressure to the wire F.

Figure 4:
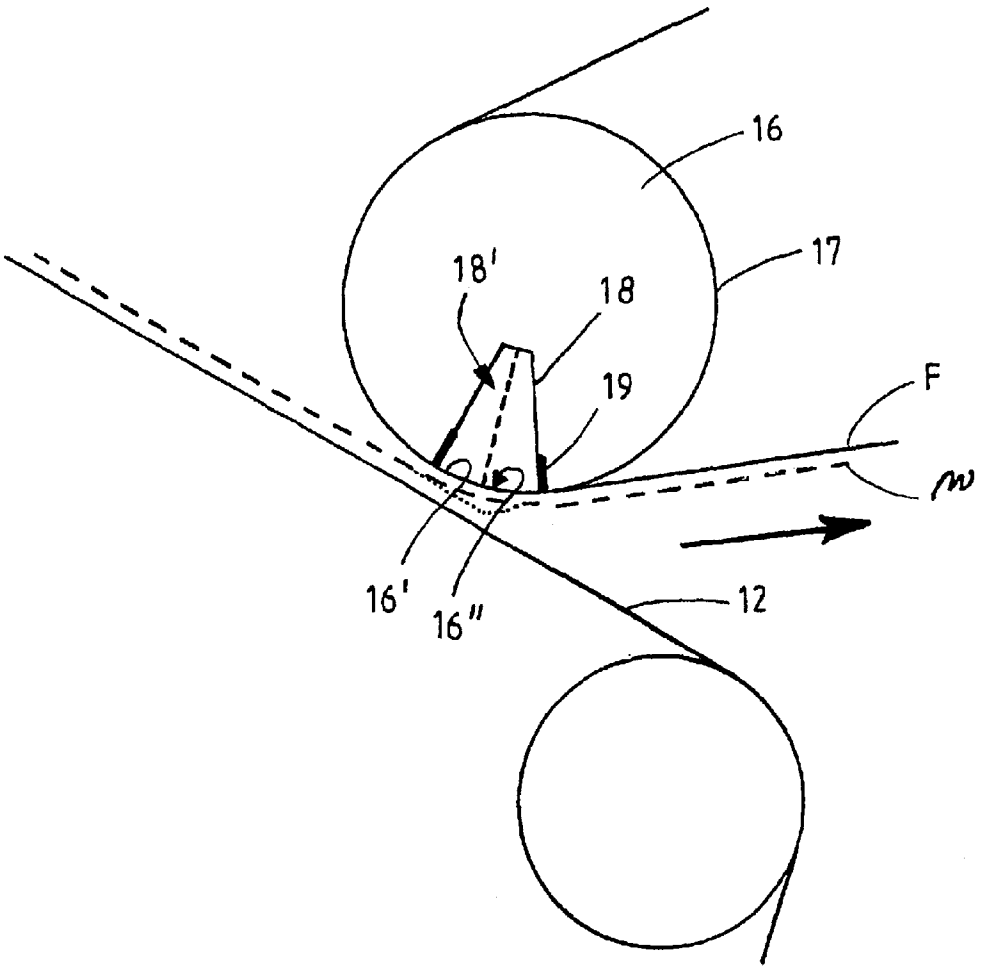
FIG. 4 shows an enlargement of the opening gap between the drying wire, which passes around the transfer suction roll, and the press section belt.

The transfer suction roll 16 is dimensioned to withstand continuously the high negative pressure required by the invention. Then the FIG. 4 shows in an enlargement the jacket 17 of the transfer suction roll 16 and the suction chamber 18 formed within the jacket, with a structure which is formed to be so rigid that it does not bend in a harmful way, even as a result of a high negative pressure. The rigid structure prevents the suction chamber and the jacket from touching each other, and the gaskets 19 between them from being damaged.

The suction chamber 18 of the transfer suction roll 16 can be divided by a partition 18', shown in FIG. 4 by a dotted line, into several suction regions 16' and 16" having negative pressures, which can be controllable independently of each other.

Supported by the wire F and the vacuum boxes 20, 20" the web w passes to the first drying cylinder 22 of the drying group 14, over the cylinder 22 and further over the suction roll 24 to the next drying cylinder 26. Below the first drying cylinder 22 there is arranged a pulper 23 or the like for receiving a web directed downwards via the doctor blade 27 of the first cylinder 22 at the beginning of the drying section, if a break occurs, or during start-up. In the pocket 28 between the cylinders 22 and 26 and the suction roll 24 there is arranged a vacuum box 30 in order to stabilise the travel of the web, particularly at the opening gap 32. Corresponding vacuum boxes 30', 30" and 30'" may be located also in the pockets between other cylinders in the first drying group 14 and in other drying groups.

Figure 3:
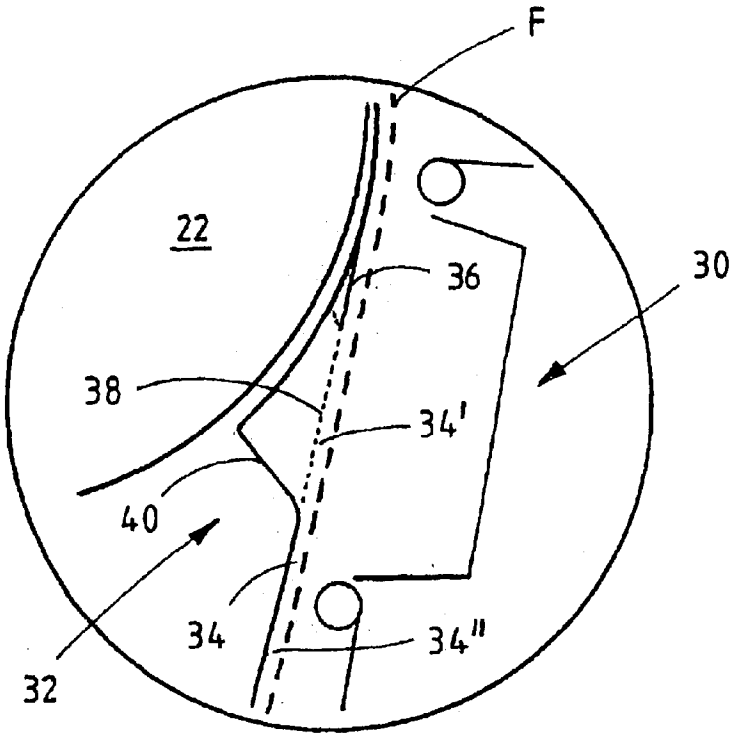
FIG. 3 shows an enlargement of the opening gap of the first drying cylinder of FIG. 2 when applying the invention.

FIG. 3 shows an enlargement of the opening gap 32 between the cylinder 22 and the wire F in FIG. 2. FIG. 3 shows a part of the vacuum box 30, which forms a negative pressure region 34 between the wire F and the box 30. The vacuum box 30 is a two-part box known as such, for instance a HiRun box from Metso Paper, Inc., which forms a region 34' with a high negative pressure between the wire and that part of the box which is closest to the opening gap 32, and a region 34" with a lower negative pressure between the wire and that part of the box which is farther away from the gap. The high negative pressure can affect the wire exactly at that point where the drying cylinder tends to detach the web from the wire. The low negative pressure supports the wire as it passes on. Thereafter the negative pressure is kept so low that it does not tend to bend the wire.

In FIG. 3 a thin line 36 represents the ideal situation, i.e. the travel of the web w, when using the invention it has been possible with the aid of the transfer suction roll 16 to attach the web so well to the wire, that the web is kept attached to the wire F as the wire is detached from the drying cylinder 22. When necessary, the attachment of the web can be secured by a vacuum box 34, by creating a necessary negative pressure in the negative pressure region 34'. There will be no pouching in the web, and the runability remains good. The vacuum box secures the attachment of the web to the wire also further on.

In FIG. 3 a dotted line 38 represents the travel of the web in the case where the web is attached to the wire with the aid of a transfer suction roll, but where the web still may slightly detach from the wire in the opening gap 32. The high negative pressure created by the vacuum box 34 in the region 34' returns the web immediately to the wire, whereby the web creates only a very small pouch, which can be reattached to the wire without harmful jerks or other inconveniences regarding the runability.

Generally the detachment of the web to a distance of at most about 2 to 5 mm from the wire still enables a good runability. The solution according to the invention ensures that the web does not detach to a too large distance from the wire, and that the web thus can be returned to the wire still maintaining a good runability. Each running situation, paper quality and other conditions determine how large a detachment can be returned without impairing the runability. In traditional drying sections the web may be detached to a distance of up to >10 mm from the wire (thick line 40 in FIG. 3), whereby a high risk of this impairing the runability exists, even if the web could be returned to the wire.

In test runs it has been able to establish that by increasing the negative pressure of the transfer suction roll it is possible to increase the machine speed, for instance from a speed of 20.5 m/s to the speed of 26.5 m/s, without the runability suffering from this, even though the tension difference between the press section and the drying section was not changed, or even as it was reduced.

Figure 5:
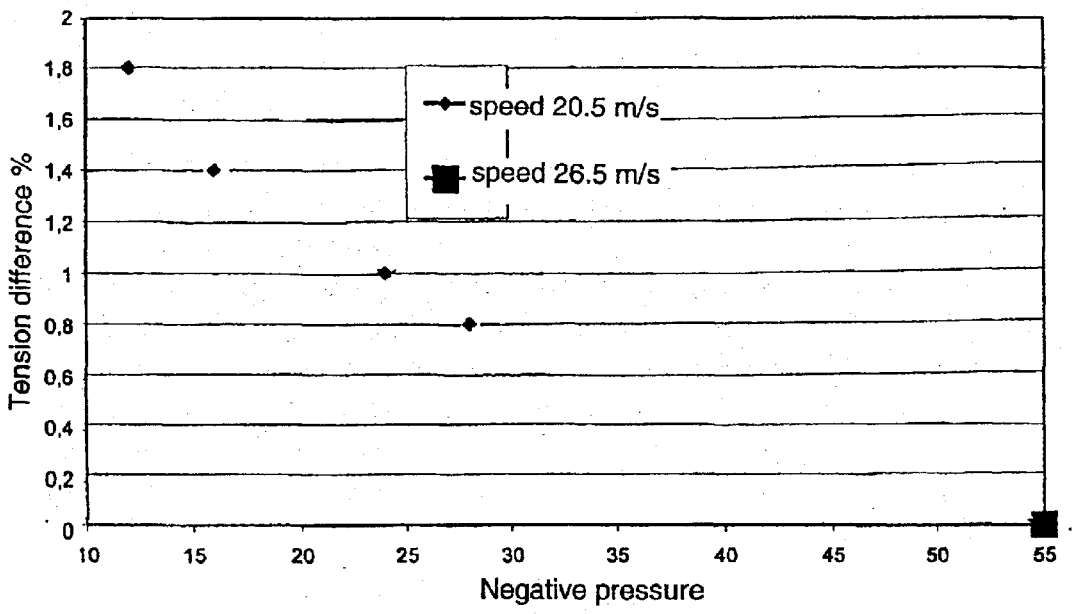
FIG. 5 is a graph showing how an increased negative pressure in the transfer suction roll can reduce the tension difference, so that the runability remains good in all cases.

FIG. 5 shows how an increased negative pressure in the transfer suction roll can reduce the tension difference, so that the runability remains good in all cases. A good runability was determined visually by observing the travel of the web w in the opening gap between the transfer wire 12 and the transfer suction roll 16 with the suction region 16'.

FIG. 4, which presents an enlargement of this opening gap, shows that the web w forms a small pouch as it returns to the wire F. The creation of a pouch shapes the web in a harmful manner, which may have a disadvantageous effect on the runability in the drying section, so the tension difference should be slightly increased in order to remove the pouch.

FIG. 5 shows that when the negative pressure increases from a negative pressure of about −12 kPa to a negative pressure of about −28 kPa, the tension difference can be reduced from 1.8% to about 0.8%. Then the running speed was about 20.5 m/s. When the negative pressure was still increased, i.e. to a pressure of about −55 kPa, the web can be run without tension in the drying section, in other words with a tension difference of 0%, and even with a higher speed than previously, i.e. with the speed of 26.5 m/s. From this can be concluded that the use of a sufficiently high negative pressure in the transfer suction roll provides a good runability, i.e. a smooth travel of the web to the drying section and in the drying section, even without any tension difference.

Figure 6:
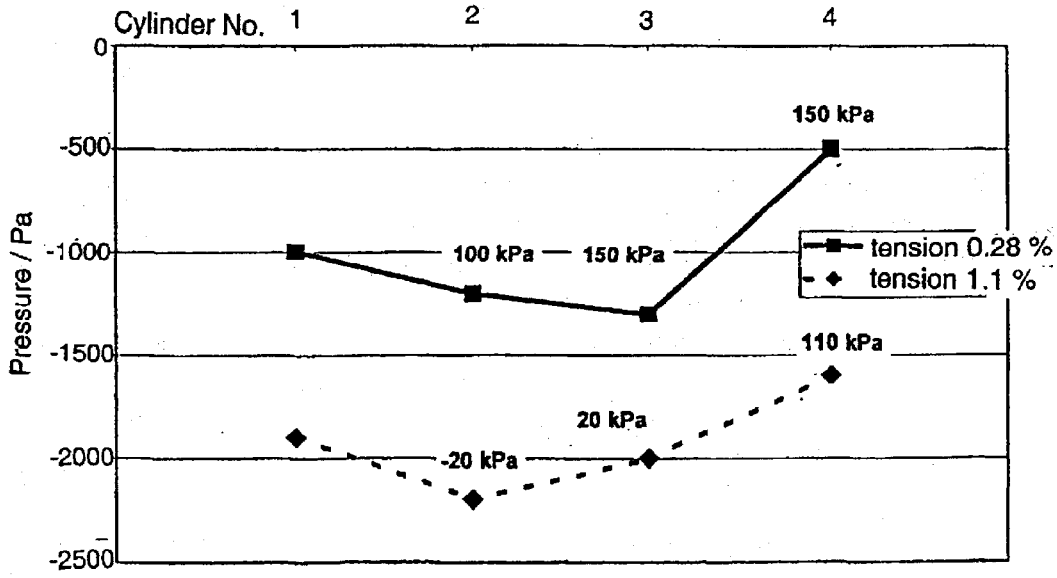
FIG. 6 is a graph of a comparison of the negative pressure required by the vacuum boxes in the first pockets of the drying section when using a high negative pressure according to the invention in the transfer suction roll and a conventional negative pressure.

FIG. 6 contains a comparison of the negative pressure required by the vacuum boxes in the first pockets of the drying section, in this case HiRun boxes of Metso Paper, Inc., when using a high negative pressure according to the invention in the transfer suction roll, in this case a pressure of −55 kPa, and a conventional negative pressure, or in this case about −25 kPa.

The values in FIG. 6 were obtained during test runs, where a 40 gram LWC base paper was run without disturbances at a speed of 27.5 m/s (1650 m/min).

First a so called conventional run was done, in other words using in the transfer suction roll a low negative pressure, −25 kPa, a tension difference of 1.1%, and low steam pressures, −20 to −110 kPa in the drying cylinders no. 1 to 4. The negative pressure level in the first HiRun vacuum boxes in the high negative pressure region of the drying section had to be kept at a negative pressure level of about −1600 to −2200 Pa in order to provide a run without disturbances. The curve shown by broken lines shows this running situation.

Then the tension difference was changed to 0.28%, whereby the running situation without disturbances was retained by increasing according to the invention, the negative pressure level in the transfer suction roll to a negative pressure level of −55 kPa, which provided a running situation without disturbances. Thus, in addition, it was possible to reduce the negative pressure in the HiRun boxes to a level of about −1300 to −500 Pa. The upper curve in FIG. 6 shows this running situation.

By increasing the negative pressure in the transfer suction roll it is thus possible

- to compensate for the running problem otherwise caused by the reduced tension difference and the increased steam temperature in the drying cylinders, and further
- to keep the negative pressure in the HiRun boxes at a reasonable level.

Among the advantages provided by the invention particularly better runability and better paper quality can be mentioned. As the web is "sucked" to the drying wire according to the invention with a high negative pressure, this will improve the runability, particularly at the beginning of the drying section, but indirectly also in the whole drying section. Thus the solution according to the invention also contributes in enabling increased speeds and efficiency of the paper machine.

The solution according to the invention makes it possible to use a remarkably lower tension difference as the paper web is passed from the press section to the drying section. In some cases the passing of the web can be made even without any tension. Then the paper quality suffers from this passing substantially less than using a conventional tension difference. In other words, the paper quality is not reduced in the same way as in conventional solutions, where it is often necessary to stretch the web, even up to extreme tolerance limits, in order to maintain a good runability. A high tension difference reduces certain quality characteristics of the paper. With the solution according to the invention this paper quality reduction can be avoided.

According to paper analyses, the roughness level or porosity, to which the tension difference could contribute, will not change when only the negative pressure of the transfer suction roll is changed.

The solution according to the invention, where the web is effectively attached with a high negative pressure to the wire of the drying section, makes also possible the use of higher steam pressures than previously in the drying cylinders, at least immediately at the beginning of the drying section, which is advantageous regarding the drying effect. Previously it was necessary to use very low steam pressures in at least the first or the few first drying cylinders.

The solution according to the invention makes it possible to maintain a good runability of the web over several cylinders.

The intention is not to confine the invention to the solutions presented above as examples, but the intention is to be able to apply the invention within the scope defined by the claims presented below.

What is claimed is:

1. A method in a paper machine for passing a web from a press section to a drying section, wherein the drying section has at least one transfer suction roll for passing the web from a transport belt, felt, or support belt in the press section, in a closed draw to a wire of a first cylinder drying group of the drying section, the first cylinder drying group having a pocket formed between at least a first drying cylinder and a second drying cylinder, the pocket containing a vacuum box stabilizinig the travel of the web, and wherein the web is detached by aid of a negative pressure of between −35 kPa and −80 kPa. (−5.075 psi and −11.6 psi) created in the at least one transfer suction roll, from said transport belt, felt or support belt and the web is brought, with the aid of the negative pressure created by the transfer suction roll, into contact with a first wire of a cylinder drying group, and wherein the web is directed and supported by said first wire, over the first drying cylinder of the cylinder drying group and further from there, supported by a hitch roll, over at least the second drying cylinder, and the travel of the web from the first drying cylinder to the hitch roll is stabilized by the vacuum box, and wherein a tension difference between the press section and the drying section is adjusted to be in the region of less than 1% when the machine speed is greater than 600 m/min.

2. The method of claim 1 wherein the negative pressure is between −40 kPa and −65 kPa.

3. The method of claim 1, wherein the wire of the first cylinder drying group forms an opening gap as the wire leaves the first drying cylinder and wherein attachment of the web to the wire in the opening gap after the first drying cylinder is secured by the vacuum box.

4. The method of claim 3, wherein the vacuum box creates a first negative pressure region substantially at the opening gap and a second negative pressure region following the first negative pressure region in the travel direction of the web, and wherein the first negative pressure region has a higher negative pressure than the second negative pressure region.

5. The method of claim 1 wherein the speed of the paper machine is greater than 1500 m/min.

6. A method in a paper machine for passing a web from a press section to a drying section, wherein the drying section has at least one transfer suction roll for passing the web from a transport belt, felt, or support belt in the press section, in a closed draw to a wire of a first cylinder drying group of the drying section, the first cylinder drying group having a pocket formed between at least a first drying cylinder and a second drying cylinder, the pocket containing a vacuum box stabilizing the travel of the web, and wherein the web is detached by aid of a negative pressure of between −35 kPa and −80 kPa. (−5.075 psi and −11.6 psi) created in the at least one transfer suction roll, from said transport belt, felt or support belt and the web is brought, with the aid of the negative pressure created by the transfer suction roll, into contact with a first wire of a cylinder drying group, and wherein the web is directed and supported by said first wire, over the first drying cylinder of the cylinder drying group and further from there, supported by hitch roll, over at least the second drying cylinder, and the travel of the web from the first drying cylinder to the hitch roll is stabilized by the vacuum box, wherein a tension difference between the press section and the drying section is adjusted to be in the region of less than 1.5% when the machine speed is 1200 to 1500 m/min.

7. A method in a paper machine for passing a web from a press section to a drying section, wherein the drying section has at least one transfer suction roll for passing the web from a transport belt, felt, or support belt in the press section, in a closed draw to a wire of a first cylinder drying group of the drying section, the first cylinder drying group having a pocket formed between at least a first drying cylinder and a second drying cylinder, the pocket containing a vacuum box stabilizing the travel of the web, and wherein the web is detached by aid of a negative pressure of between −35 kPa and −80 kPa. (−5.075 psi and −11.6 psi) created in the at least one transfer suction roll, from said transport belt, felt or support belt and the web is brought, with the aid of the negative pressure created by the transfer suction roll, into contact with a first wire of a cylinder drying group, and wherein the web is directed and supported by said first wire, over the first drying cylinder of the cylinder drying group and further from there, supported by a hitch roll, over at least the second drying cylinder, and the travel of the web from the first drying cylinder to the hitch roll is stabilized by the vacuum box, wherein a tension difference between the press section and the drying section is adjusted to be in the region of less than 2% wherein the machine speed is 1500 to 1800 m/min.

8. A method in a paper machine for passing a web from a press section to a drying section, wherein the drying section has at least one transfer suction roll for passing the web from a transport belt, felt, or support belt in the press section, in a closed draw to a wire of a first cylinder drying group of the drying section, the first cylinder drying group having a pocket formed between at least a first drying cylinder and a second drying cylinder, the pocket containing a vacuum box stabilizing the travel of the web, and wherein the web is detached by aid of a negative pressure of between −35 kPa and −80 kPa. (−5.075 psi and −11.6 psi) created in at least one transfer suction roll, from said transport belt, felt or support belt and the web is brought, with the aid of the negative pressure created by the transfer suction roll, into contact with a first wire of a cylinder drying group, and wherein the web is directed and supported by said first wire, over the first drying cylinder of the cylinder drying group and further from there, supported by a hitch roll, over at least the second drying cylinder, and the travel of the web from the first drying cylinder to the hitch roll is stabilized by the vacuum box, wherein a tension difference between the press section and the drying section is adjusted to be in the region of less than 2.5% when the machine speed is greater than 1800 m/min.

9. A method of manufacturing a paper web comprising:

passing a closed draw a web from a pressing section transport belt to a first wire of a first cylinder drying group with a transfer suction roll applying a negative pressure of between 35 kPa and 80 kPa to the first wire;

wrapping the first wire around a first drying cylinder of the first cylinder drying group;

wrapping the wire from the first drying cylinder to a hitch roll, and from the hitch roll to a second drying cylinder of the first cylinder drying group to form a pocket between the first drying cylinder and the second drying cylinder;

wherein the wire of the first cylinder drying group forms an opening gap as the wire leaves the first drying cylinder and travels to the hitch roll; and attaching the web to the wire in the opening gap after the first drying cylinder by a vacuum box positioned in the pocket between the first drying cylinder and the second drying cylinder, wherein a tension difference between the press section and the drying section is less than 2% when the machine speed is greater than 1500 m/min.

10. The method of claim 9, wherein the vacuum box creates a first negative pressure region substantially at the opening gap and a second negative pressure region following the first pressure region in the travel direction of the web wherein the first negative pressure region has a higher negative pressure than the second negative pressure region.

11. The method of claim 10, wherein the first negative pressure region is between −1300 Pa and −500 Pa.

* * * * *